US005179757A

United States Patent [19]

Grant, Jr.

[11] Patent Number: 5,179,757

[45] Date of Patent: Jan. 19, 1993

[54] APPARATUS FOR DESCALING A PROCESS VESSEL

[75] Inventor: Louis A. Grant, Jr., Pittsburgh, Pa.

[73] Assignee: Louis A. Grant, Inc., Pittsburgh, Pa.

[21] Appl. No.: 855,524

[22] Filed: Mar. 23, 1992

[51] Int. Cl.[5] ..... F22B 37/48

[52] U.S. Cl. ..... 15/246.5; 15/104.096; 15/104.07; 299/70

[58] Field of Search ..... 15/56, 104.05, 104.07, 15/104.09, 104.1 C, 246.5; 173/90; 299/69, 70

[56] References Cited

U.S. PATENT DOCUMENTS

| | | | |
|---|---|---|---|
| 1,325,638 | 12/1919 | Healey . | |
| 1,569,203 | 1/1926 | Rice et al. | 15/104.09 |
| 2,170,660 | 8/1939 | Langmyhr | 15/104.1 C |
| 2,710,418 | 6/1955 | Putnum | 299/70 |
| 3,302,976 | 2/1967 | Grant | 15/104.07 |
| 3,370,888 | 2/1968 | Skendrovic | 299/70 |
| 3,471,888 | 10/1969 | Grant et al. | 15/104.07 |
| 3,679,477 | 7/1972 | Zimmer . | |
| 4,210,976 | 7/1980 | Apelt et al. | 15/246.5 |
| 5,020,183 | 6/1991 | Grant, Jr. | 15/246.5 |

FOREIGN PATENT DOCUMENTS

| | | | |
|---|---|---|---|
| 147321 | 1/1904 | Fed. Rep. of Germany | 299/69 |
| 684726 | 12/1939 | Fed. Rep. of Germany | 15/104.1 C |
| 57933 | 4/1966 | Fed. Rep. of Germany . | |
| 3641938 | 6/1988 | Fed. Rep. of Germany | 299/70 |
| 514261 | 2/1955 | Italy . | |
| 1-286900 | 11/1989 | Japan . | |
| 447031 | 3/1968 | Switzerland . | |

*Primary Examiner*—Harvey C. Hornsby
*Assistant Examiner*—Mark Spisich
*Attorney, Agent, or Firm*—Webb, Burden, Ziesenheim & Webb

[57] ABSTRACT

Apparatus for removing deposits from the interior surface of a vessel wall including an elongated support column having its upper end attached to a cable to position the support column vertically within the vessel. A hammer assembly pivotally and rotatably attached to the lower end of the support column and a plurality of cylinders having one end pivotally connected to the lower end of the support column and a contact member at the other end for contacting the inner surface of the vessel wall to position the hammer assembly horizontally within the vessel. A motor on the lower end of the support column to rotate the hammer assembly about the longitudinal axis of the support column and hydraulic cylinders connected to the hammer assembly to pivot the hammer assembly relative to the longitudinal axis of the support column and to slide the hammer assembly relative to the longitudinal axis of the support column to position the bit on the hammer relative to the inner surface of the vessel wall.

9 Claims, 5 Drawing Sheets

APPARATUS FOR DESCALING A PROCESS VESSEL

BACKGROUND OF THE INVENTION

The invention relates generally to apparatus for cleaning the interior surface of the wall of a process vessel and, more particularly, to apparatus for removing scale and other deposits from the interior surface of the wall of digester vessels such as those used in an aluminum production process.

Typically, vessels of this type are large cylindrical vessels having a diameter of approximately 9 to 14 feet and a height on the order of 50 to 75 feet. A hard glass-like scale gradually builds up on the interior surface of the wall of the vessel as the process is continuously practiced therein. The thickness of the scale can be on the order of 5 to 6 inches and removal thereof is extremely labor intensive, dangerous and time consuming due to the configuration of the vessel and the limitations imposed by manually operated tools and by known scaffolding and rigging arrangements within the vessel. One example of an apparatus for chipping the scale from the inside of a vessel is disclosed in U.S. Pat. No. 5,020,183 which is owned by the assignee of the instant application. The limited access to the interior of a typical aluminum process digester vessel also presents a problem because the restricted opening afforded by the manhole at the closed top of the vessel is usually only 19 to 32 inches in diameter which prevents the use of any but lightweight tools and rigging of limited dimensions.

The present invention solves many of the problems heretofore encountered in cleaning the inner surface of the wall of an aluminum digester or other process vessel. The present invention provides apparatus which substantially reduces the amount of time and expense required to clean the interior surface of the wall of a vessel while concurrently producing a relatively clean scale-free wall surface. Additionally, the utilization of this equipment creates a safe working environment since the operator is not located inside of the vessel.

The present apparatus includes a rigging for lowering a chipping hammer into the vessel and for positioning that chipping hammer so that the bit can contact the full interior surface of the vessel wall both radially and vertically. The hammer is a heavy duty impact tool which has high power capabilities and can remove the very thick and hard deposits which are extremely difficult and time consuming when manual tools are used.

Still further, the apparatus of the invention provides a stable construction having a plurality of hydraulically operated stabilizer arms within the vessel to contact the interior surface of the vessel wall. The equipment can be collapsed into a configuration which can be lowered through the relatively restricted access manhole at the upper end of the vessel and can be placed in its operating condition after it is inside the vessel.

An electronic camera is attached to the boom of the impact tool so that the operator is in constant visual contact with the operation of the impact tool chipping bit to monitor the operation.

SUMMARY OF THE INVENTION

The invention is directed to apparatus for removing hard deposits from the interior surface of the wall of a process vessel which has an access manhole of limited diameter at the upper end thereof. The apparatus includes a rigging for positioning an impact hammer both vertically and radially within the vessel so that the chipping bit on the impact hammer can contact all of the areas of the vessel wall which are to be cleaned. The apparatus is positioned and operated by fluid-operated cylinders and the operator controls the apparatus by using a closed circuit camera mounted on the apparatus to constantly monitor the position of the apparatus and the condition of the scale on the surface of the vessel wall. The apparatus is suspended within the vessel on a cable which is attached to a rigging outside of the vessel which lowers the apparatus through a manhole in the top of the vessel and raises and lowers the apparatus within the vessel to the desired vertical position for cleaning. The impact tool is preferably a hydraulically actuated hammer having a reciprocal impact bit and it is pivotally and extensibly mounted on a support column by a boom and a support arm assembly. The support arm assembly is positioned radially within the vessel by a plurality of spider-like stabilizer arms which extend radially outwardly from a central hub and contact the interior surface of the vessel wall to locate the hammer and hold it in a relatively stable position. The radial stabilizer arms also center the impact hammer support column within the vessel. A hydraulic power supply unit is located outside of the vessel and is coupled to the various cylinders by flexible hoses so that the apparatus can be moved into desired positions within the vessel. Movement of the hammer is thus achieved in several degrees of freedom to assure a proper tool position relative to the interior surface of the vessel wall and to provide access to substantially all of that surface.

The above as well as other features and advantages of the present invention will become more apparent when reference is made to the detailed specification set forth hereinafter when read with the accompanying drawings wherein like reference characters refer to like parts throughout.

DESCRIPTION OF THE PREFERRED EMBODIMENT

Figure 1:
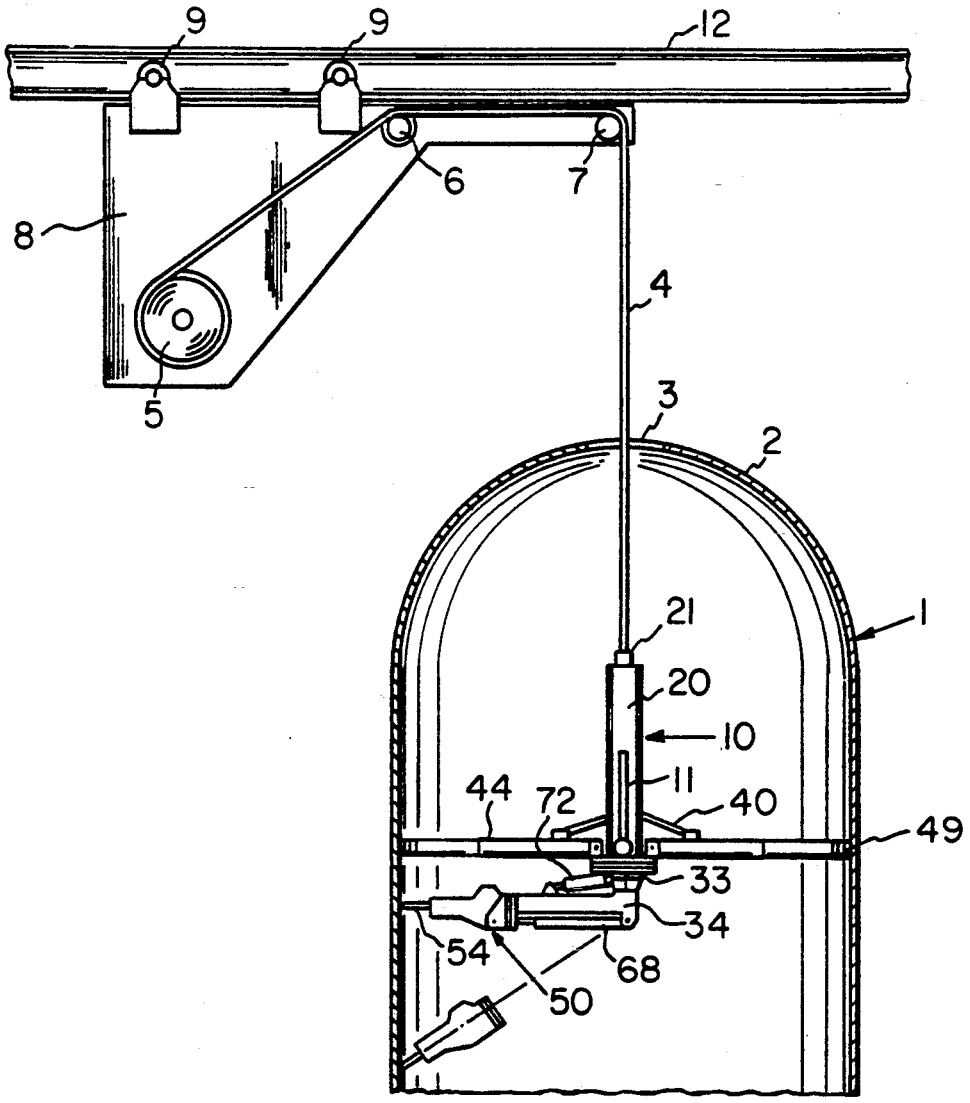
FIG. 1 is a vertical section through the top of a vessel showing the cleaning apparatus in the vessel.

With reference to FIG. 1 of the drawings, it will be seen that the vessel 1 has a dome-shaped upper end 2 with a manhole 3 at the top to provide access to the interior of the vessel. The cleaning apparatus 10 is suspended inside of the vessel from a cable 4 which is supported by pulleys 5, 6 and 7 mounted on a moveable carriage 8. The carriage rides along a rail 12 with rollers 9. The mounting arrangement or rigging makes it possible to raise and lower cleaning apparatus 10 to position it vertically within a vessel and to move it laterally along rail 12 so that it can be used to clean different vessels. The specific design of the rigging is well known to one skilled in the art and forms no part of the invention.

Cleaning apparatus 10 consists of an elongated hollow support column 20 which has an end cap 29 on the upper end. A bracket 21 is fixed to end cap 29 for attachment to an end of cable 4. A hydraulic cylinder 25 having a piston therein is located coaxially within column 20. One end of a piston rod 26 is attached to the piston in cylinder 25 and the rod extends from the upper end of cylinder 25. The distal end of piston rod 26 is pivotally attached by pin 27 to end cap 29 at the upper end of column 20. A bracket 28 is attached to the lower end of cylinder 25 and four radially extending triangular lugs 24 having a 90° spacing are welded to the exterior of bracket 28 for a purpose to be described hereinafter. Each lug 24 has a hole adjacent the upper end.

An impact hammer bracket 30 is located at the lower end of column 20. Bracket 30 includes a plate 31 welded to the lower end of column 20 and four radially extending lugs 32 are welded to the upper surface of plate 31 and to the exterior of column 20. Lugs 32 are located in the same vertical planes as lugs 24 on bracket 28 and each lug has a hole adjacent to its upper and outer corner.

One end of an arm 40 is pivotally attached by a pin 41 to the hole in each lug 29 on bracket 28 and extends outwardly from the lug through an elongated slot 11 in column 20. The four slots 11 are located in the same vertical planes as lugs 24 and 32. The slots are elongated so that arms 40 can fit into column 20 when the cleaning apparatus is in the collapsed position shown in FIG. 2 of the drawings. The end of each arm 40 opposite pivot pin 41 is pivotally attached by a pivot pin 42 to a lug 43 which is welded to the outside of a cylinder 44. Each cylinder 44 has one end pivotally attached to a lug 32 by a pivot pin 45. A hydraulic cylinder 46 is located within each cylinder 44 and a piston rod 47 is attached to a piston within cylinder 46 and extends outwardly from one end of cylinder 46. The distal end of each piston rod 47 is pivotally attached to the end of the corresponding cylinder 44 which is pivotally attached to a lug 32. A contact member 48 is attached to the end of each cylinder 46 opposite the end from which piston rod 47 extends. Each contact member 48 has an elastic pressure pad 49 on its free end. The pressure pads 49 on contact members 48 contact the inner surface of the vessel wall as shown in FIG. 1 of the drawings when cleaning apparatus 10 is in its operating position and piston rods 47 extend cylinders 46 away from the closed end of cylinder 44. The amount of force applied to each pad is sufficient to firmly position the cleaning apparatus in the interior of the vessel without damaging the vessel wall. As will be apparent to those skilled in the art, the utilization of four cylinders 44 having 90° radial spacing provides a firm base for the cleaning apparatus within the vessel. While four arms spaced apart 90° are shown in the drawings, it should be understood that two or more arms having equal radial spacing may be used without departing from the scope of the invention.

The bracket 30 has a lower plate 22 rotatably attached to upper plate 31 by Rotek gear 38 having a shaft 37. The rotatable shaft 37 and a pinion gear 91 driven by a hydraulic motor 90 rotate Rotek gear 37 and lower plate 22. Spaced arms 33 are welded to plate 22 to form a downwardly extending clevis. A lug 39 is welded to one end of an outer boom 34, which is a part of hammer assembly 50, and the lug is pivotally attached to arms 33 by a pivot pin 36. A downwardly extending lug 35 is also welded to the lower surface of plate 22 between arms 33 of the clevis.

Hammer assembly 50 includes outer boom 34 which has an inner boom 80 slideably mounted therein. Spaced arms 81 extend from a plate 82 carried on the end of the inner boom to form a clevis on the end of the inner boom. A hammer bracket having spaced members 52 is pivotally mounted on the clevis formed by arms 81 by stub pivot pins 62 so that the hammer can pivot relative to inner boom 80. A conventional hydraulic reciprocating chipping hammer 53 having a replaceable bit 54 on its end is located between spaced members 52. The hammer and bit are well known and the construction thereof does not form a part of the instant invention. The rear end of each member 52 is attached to a cross pivot pin 55. A link 56 having spaced sides has one end connected to pivot pin 55 and the other end of link 56 is connected by a pivot pin 57 to the distal end of a piston rod 58 which extends from one end of a piston located in a cylinder 59 within inner boom 80. A clevis 63 is attached to the opposite end of cylinder 59 and the clevis is pivotally connected by a pin 60 to a lug 61 which is welded to the end of inner boom 80. Extension of rod 58 from cylinder 59 pivots members 52 and hammer 53 about pivot pins 62 on arms 81. This permits the tip of bit 54 to be located in the desired position relative to the interior surface of the vessel wall.

A downwardly extending lug 65 is attached at the end of outer boom 34 and the distal end of a piston rod 66 is pivotally attached to bracket 65 by a pivot pin 67. The other end of piston rod 66 is attached to a piston located in a cylinder 68. The end of cylinder 68 opposite the end from which rod 66 extends is pivotally attached to a pin 69 extending between arms 81. Extension of rod 66 from cylinder 68 moves inner boom 80 and hammer assembly 50, which is attached to the end of the inner boom, longitudinally relative to outer boom 34.

An upwardly extending lug 70 is welded to the top of outer boom 34 adjacent its forward end and the distal end of a piston rod 71, which extends from the end of a cylinder 72, is pivotally attached to the lug by a pivot pin 74. The opposite end of cylinder 72 is pivotally attached by a pin 73 to lug 35 on the bottom surface of lower plate 22. Longitudinal movement of rod 71 relative to cylinder 72 pivots outer boom 34 about pivot pin 36.

Figure 4:
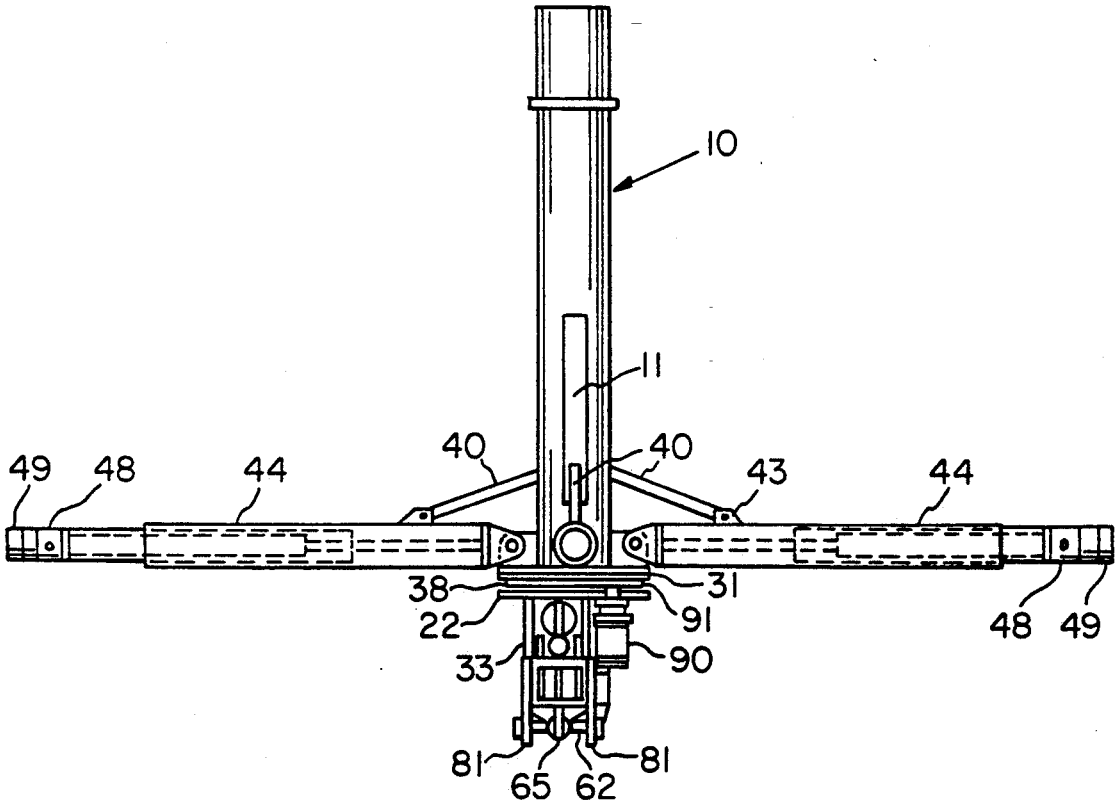
FIG. 4 is a rear elevation of the cleaning apparatus.
Figure 8:
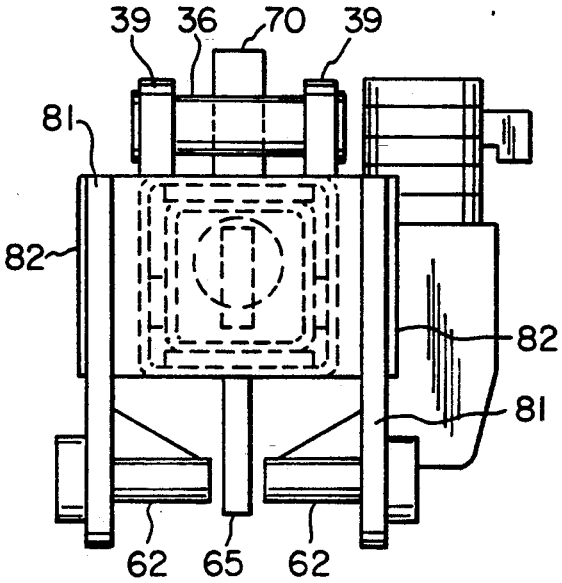
FIG. 8 is an end view of the boom assembly.
Figure 5:
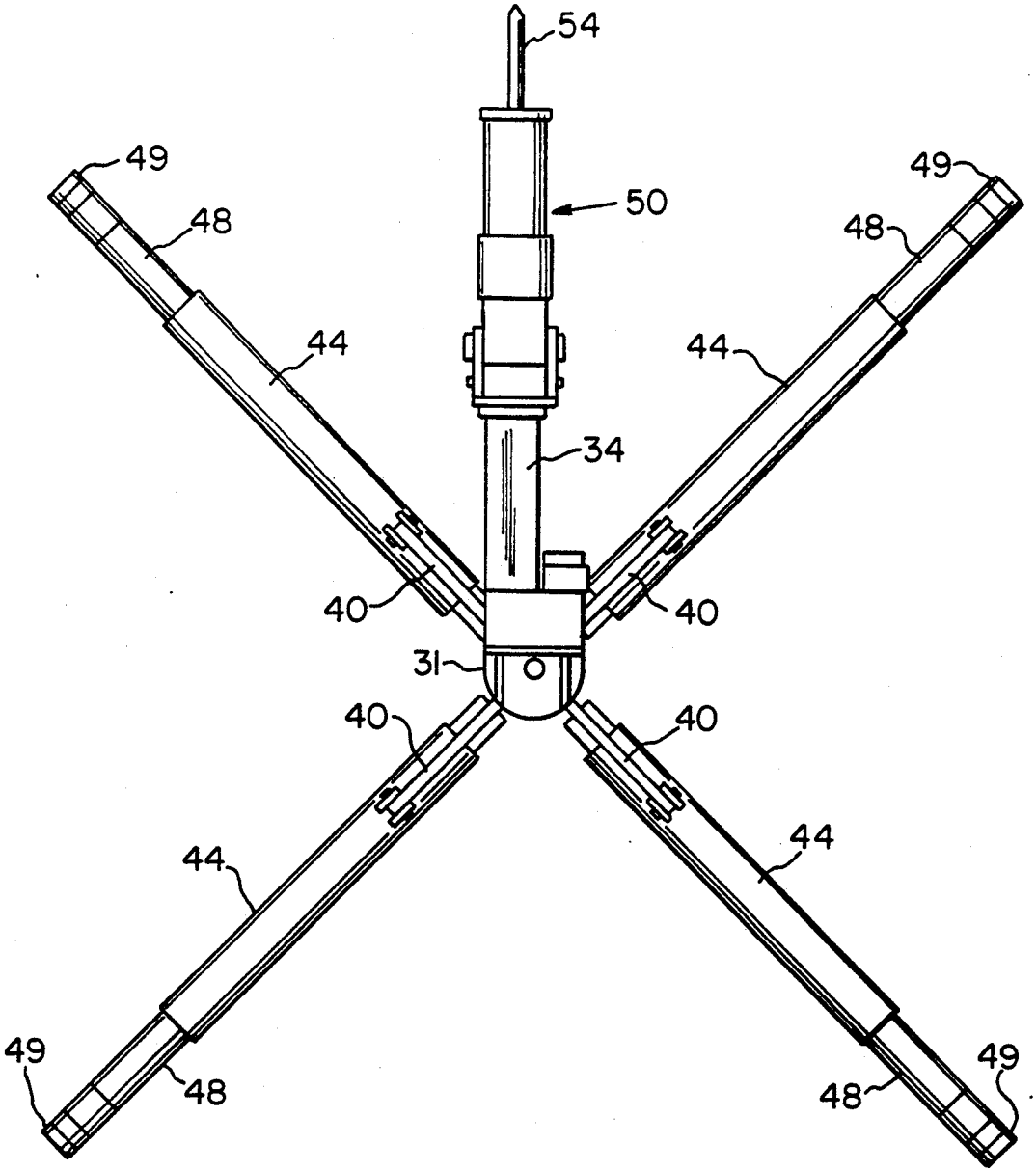
FIG. 5 is a plan view of the cleaning apparatus.
Figure 6:
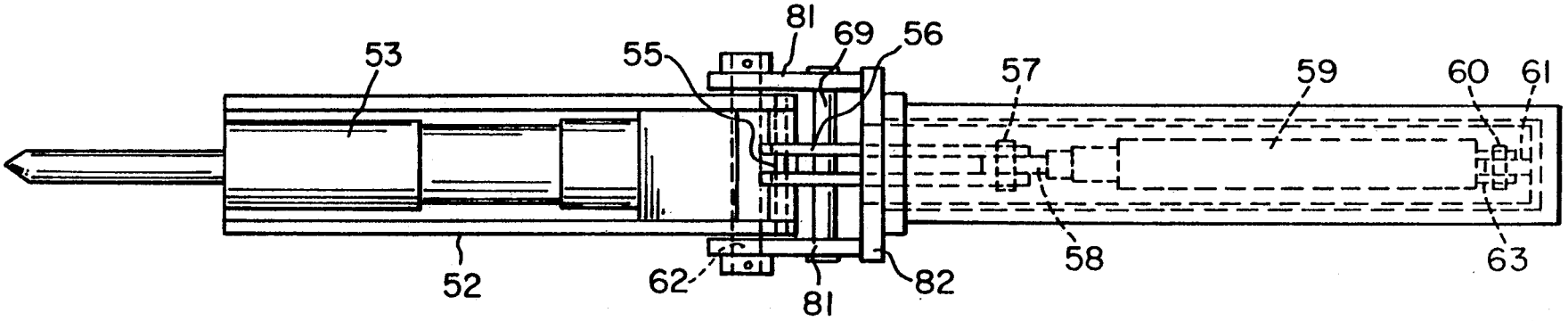
FIG. 6 is a plan view of the impact hammer and the boom assembly.
Figure 7:
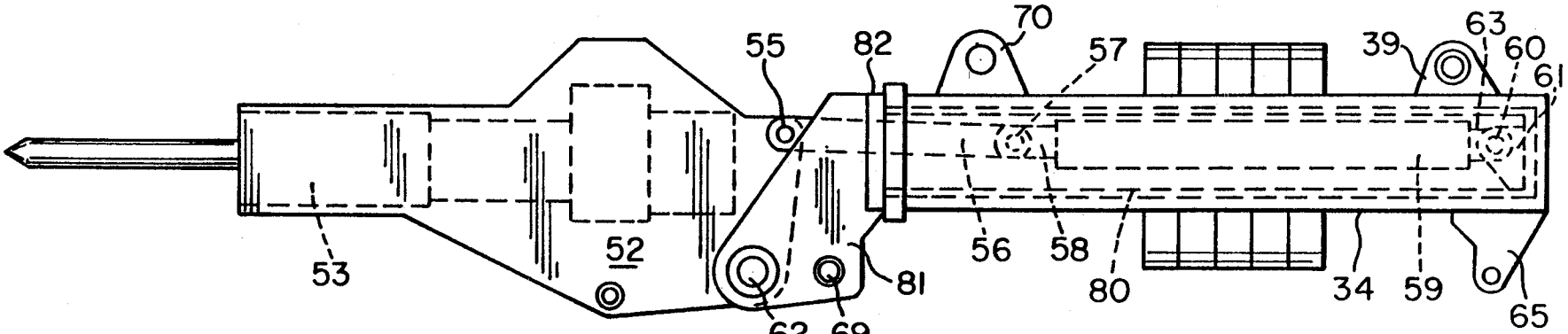
FIG. 7 is a side view of the impact hammer and the boom assembly.

With reference to FIG. 4 of the drawings, it will be seen that a hydraulic motor 90 is mounted on the bottom surface of lower plate 22. A rotary gear 91 is driven by motor 90 and is located between plates 31 and 22. Gear 91 engages Rotek gear 38 which is mounted on shaft 37 so that motor 90 rotates gear 91 to rotate gear 38 and thereby rotate shaft 37 and lower plate 22 to rotate the impact hammer assembly to position bit 54 around the circumference of the vessel.

Figure 2:
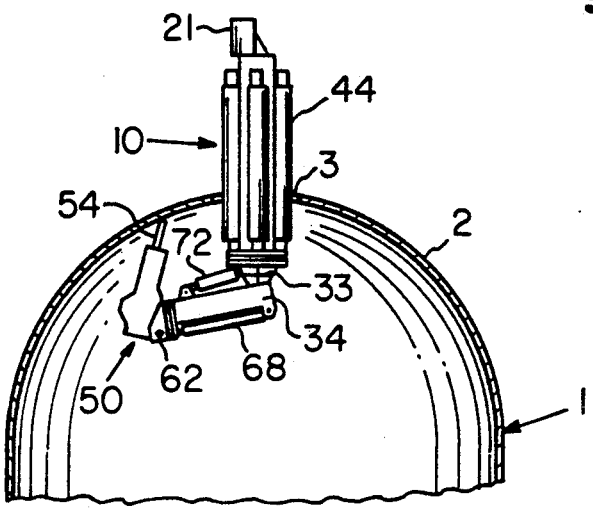
FIG. 2 is a vertical section through the top of a vessel with the cleaning apparatus in position to clean the vessel dome.
Figure 3:
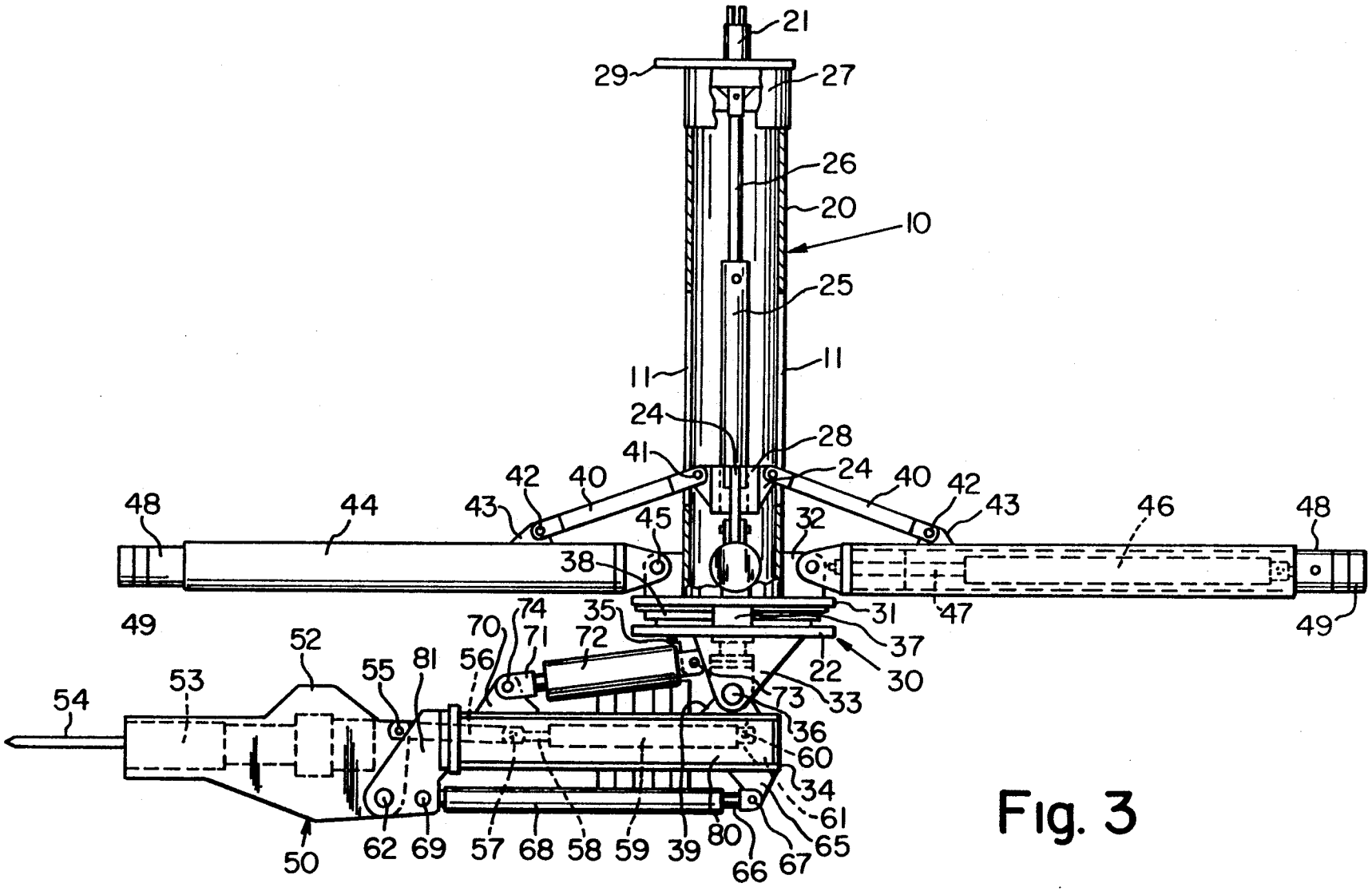
FIG. 3 is a partial section showing a side elevation of the cleaning apparatus.

In operation, cylinders 44 are rotated into the position parallel to support column 20 as shown in FIG. 2 of the drawings so that outer boom 34 and hammer assembly 50 are substantially parallel to the axis of support column 20. When the cleaning apparatus is in the position shown in FIG. 2, it can be lowered into the vessel through access manhole 3 and removed therefrom when descaling is completed. When the cleaning apparatus is located in the vessel, support column 20 is located on the vertical axis of the vessel in the desired location along the vertical axis of the vessel and cylinders 44 are pivoted into the lower position shown in FIGS. 1 and 4 of the drawings. Rods 47 are extended to place pads 49 into firm contact with the inner surface of the vessel wall to hold the cleaning apparatus in position in the vessel. The hammer assembly 50 is then positioned by cylinders 59, 68 and 72 and hydraulic motor 90 to locate bit 54 in the desired position to remove scale from the inner surface of the vessel wall. The hammer is then actuated to reciprocate the bit to loosen the scale.

When the dome of a vessel is to be cleaned, cylinders 44 are placed in the upright position and the hammer assembly 50 is pivoted about pin 62 as shown in FIG. 2 of the drawings so that bit 54 can contact the inner surface of the vessel dome.

The utilization of the cleaning apparatus makes it possible to descale the total surface of the vessel wall without any manual involvement.

The foregoing describes a preferred embodiment of the invention and is given by way of example only. The invention is not limited to any of the specific features described herein, but includes all such variations thereof within the scope of the appended claims.

I claim:

1. Cleaning apparatus for removing deposits from the inner surface of the wall of a vessel having a vertical longitudinal axis and a dome at the upper end with an access opening therein, said apparatus comprising:

a) an elongated support column having an upper end and a lower end, b) means at the upper end of said support column adapted to be attached to an end of a cable extending through the access opening and connected to a movable rigging located exteriorly of the vessel to adjustably position said support column within said vessel along the vertical longitudinal axis of the vessel, c) a hammer assembly having a reciprocating hammer with a removable bit, d) means for pivotally and rotatably attaching said hammer assembly to the lower end of said support column, e) a plurality of cylinders having a first end pivotally connected adjacent the lower end of said support column and including adjustable contact means on a second end for frictionally engaging the inner surface of the wall of the vessel to position said hammer assembly horizontally within the vessel, f) means for pivoting each of said cylinders between a first position substantially parallel to the longitudinal axis of said elongated support column and a second position substantially perpendicular to the longitudinal axis of said elongated support column, g) means for rotating said hammer assembly about the longitudinal axis of said elongated support column to position said bit for contact with the inner surface of the vessel wall, h) means for pivoting said hammer assembly relative to the longitudinal axis of said elongated support column to angularly position said bit for contact with the inner surface of the vessel wall, and i) means for sliding said hammer assembly relative to the longitudinally axis of said elongated support column to laterally position said bit for contact with the inner surface of the vessel wall, whereby said bit is adjustable to contact the complete inner surface of the vessel wall.

2. The apparatus set forth in claim 1 wherein said elongated support column is hollow, a piston cylinder having a first end and a second end located coaxially within said support column, a piston rod extending from the first end of said cylinder and having its distal end pivotally connected to said means at the upper end of said support column, a lift bracket attached to the second end of said cylinder, said lift bracket including a first plurality of radially outwardly extending lugs, a second plurality of radially outwardly extending lugs attached to the outside of the lower end of said support column located in the same plane as said first lugs on said lift bracket, an elongated slot formed in the wall of said support column in each plane including said radially outwardly extending second lugs on the outside of said support column, an arm extending out of said support column through each of said slots and having a first end pivotally connected to one of said first lugs on said lift bracket within said support column for pivotal movement relative to said lug, said arm having a second end pivotally connected to one of said plurality of cylinders whereby extension of said rod from said piston cylinder lowers said lift bracket and rotates each of said plurality of cylinders from said first position substantially parallel to the longitudinal axis of said support column to said second position substantially perpendicular to the longitudinal axis of said support column and retraction of said rod into said piston cylinder raises said lift bracket to move each of said plurality of cylinders from said second position to said first position.

3. The apparatus set forth in claim 1 wherein each of said plurality of cylinders has a piston cylinder and a piston located coaxially therein, a piston rod attached to said piston in each of said piston cylinders and having a first end pivotally attached to the end of said cylinder adjacent to the exterior of said support column, and said contact means is a pad at a second end of each of said piston cylinders, whereby extension of said piston rod from said piston cylinder forces said pad into contact with the inner surface of the vessel wall to position said hammer assembly relative to the vertical longitudinal axis of the vessel and retraction of said piston rod into said piston cylinder removes said pad from contact with the inner surface of the vessel wall.

4. The apparatus set forth in claim 1 wherein said means for rotatably attaching said hammer assembly to the lower end of said support column includes a first plate having an upper surface attached to the lower end of said support column and a lower surface, a second plate having an upper surface spaced from said first plate and a lower surface and a swing bearing located between said first and second plates to connect said second plate to said first plate, a rotary shaft extending between said first and second plates for rotation of said second plate relative to said first plate and said support column, a swing motor attached to said second plate and having a drive gear meshing with said swing bearing to rotate said second plate and said hammer assembly relative to said first plate and said support column, whereby rotation of said second plate rotates said hammer assembly to position said bit for contact with the inner surface of the vessel wall.

5. The apparatus set forth in claim 4 wherein said means for pivotally attaching said hammer assembly to the lower end of said support column includes spaced lugs depending from said lower surface of said second plate, a pivot pin extending between the lower end of said spaced lugs and means on said hammer assembly for connecting said hammer assembly to said pivot pin, whereby said reciprocating hammer can pivot between a first position substantially perpendicular to the longitudinal axis of said support column and a second position substantially parallel to the longitudinal axis of said support column.

6. The apparatus set forth in claim 1 wherein said hammer assembly includes a hollow outer boom and a hollow inner boom located within said hollow outer boom, each of said booms having a closed end and an open end, a piston cylinder located within said inner boom and having a first end pivotally attached to the closed end of said inner boom, a piston rod attached to the piston in said piston cylinder and extending from the second end of said piston cylinder, a link pivotally connected to the distal end of said rod and extending through the open end of said inner boom, spaced hammer plates attached to said open end of said inner boom and pivot means supporting said reciprocating hammer on said spaced hammer plates, the distal end of said link attached to a pivot pin supported on said hammer, whereby extension of said rod from said piston cylinder in said inner boom rotates said hammer about said pivot means to position said bit for contact with the inner surface of the vessel wall.

7. The apparatus set forth in claim 1 wherein said hammer assembly includes a hollow outer boom and a hollow inner boom located within said hollow outer boom, each of said booms having a closed end and an open end, a piston cylinder located within said inner boom and having a first end pivotally attached to the closed end of said inner boom, a piston rod attached to the piston in said piston cylinder and extending from the second end of said piston cylinder, a link pivotally connected to the distal end of said rod and extending through the open end of said inner boom, spaced hammer plates attached to said open end of said inner boom and pivot means supporting said reciprocating hammer on said spaced hammer plates, the distal end of said link attached to a pivot pin supported on said hammer, whereby extension of said rod from said piston cylinder in said inner boom rotates said hammer about said pivot means to position said bit for contact with the inner surface of the vessel wall.

8. The apparatus set forth in claim 7 including another downwardly extending lug on said lower surface of said second plate located between said spaced lugs depending from said lower surface of said second plate and an upwardly extending lug located adjacent said open end of said outer boom, a piston cylinder having a first end pivotally connected to said another lug on said lower surface of said second plate and a piston rod extending from the second end of said piston cylinder and pivotally connected to said lug adjacent said open end of said outer boom, whereby extension of said piston rod from said piston cylinder rotates said outer boom and said reciprocating hammer about said pivot pin extending between said spaced depending arms.

9. The apparatus set forth in claim 8 including a downwardly depending lug adjacent said closed end of said outer boom, a piston cylinder having a first end pivotally connected to said spaced hammer plates and a piston rod extending from the second end of said piston cylinder and having its distal end pivotally connected to said lug adjacent said closed end of said outer boom, whereby extension and retraction of said piston rod from said piston cylinder slides said inner boom relative to said boom to position said bit for contact with the inner surface of the vessel wall.

* * * * *